US012742302B1

(12) United States Patent
Kenkel et al.

(10) Patent No.: US 12,742,302 B1
(45) Date of Patent: Sep. 22, 2026

(54) EXCAVATOR BUCKET CONTROL

(71) Applicant: Deere & Company, Moline, IL (US)

(72) Inventors: Aaron R. Kenkel, Hazel Green, WI (US); John R. Mahrenholz, Dubuque, IA (US); Adam J. Mueller, Asbury, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 19/207,539

(22) Filed: May 14, 2025

(51) Int. Cl.
*E02F 3/43* (2006.01)
*E02F 9/26* (2006.01)

(52) U.S. Cl.
CPC ..... *E02F 3/437* (2013.01); *E02F 9/265* (2013.01)

(58) Field of Classification Search
CPC ..... E02F 3/437; E02F 9/265
See application file for complete search history.

(56) References Cited

U.S. PATENT DOCUMENTS

| | | | | |
|---|---|---|---|---|
| 4,958,981 | A | 9/1990 | Uchihashi | |
| 10,202,740 | B2 | 2/2019 | Stockhaus et al. | |
| 11,377,815 | B2 | 7/2022 | Yamashita | |
| 11,608,600 | B2 | 3/2023 | Smith et al. | |
| 11,873,621 | B2 | 1/2024 | Kean | |
| 12,006,663 | B2 | 6/2024 | Kean | |
| 2008/0018271 | A1* | 1/2008 | Morinaga | E02F 9/123 318/257 |
| 2011/0264336 | A1 | 10/2011 | Bengtsson | |
| 2021/0095441 | A1 | 4/2021 | Jonsson | |
| 2021/0254304 | A1* | 8/2021 | Konda | E02F 3/32 |
| 2022/0074165 | A1* | 3/2022 | Iwasaki | E02F 9/265 |
| 2022/0106764 | A1* | 4/2022 | Iwasaki | E02F 9/2221 |
| 2022/0127825 | A1* | 4/2022 | Iwasaki | E02F 9/22 |
| 2022/0403617 | A1* | 12/2022 | Matsuyama | E02F 3/3677 |
| 2023/0038266 | A1 | 2/2023 | Kean | |
| 2025/0297464 | A1* | 9/2025 | Bakken | E02F 9/267 |
| 2025/0347090 | A1* | 11/2025 | Hodel | E02F 3/32 |

OTHER PUBLICATIONS

Co-Pending U.S. Appl. No. 19/207,548, filed May 14, 2025 (not prior art).
Co-Pending U.S. Appl. No. 18/815,966, filed Aug. 27, 2024 (not prior art).

* cited by examiner

*Primary Examiner* — Hussein Elchanti
(74) *Attorney, Agent, or Firm* — Jerry T. Sewell; Lucian Wayne Beavers; Patterson Intellectual Property Law, PC

(57) ABSTRACT

A work machine includes a main frame and a work implement, which includes a first end movably coupled to the main frame and a second end distal to the main frame. A joint assembly is coupled to the work implement's second end and a working tool is associated with the joint assembly. The joint assembly actuates the working tool between first and second working tool positions along an operating trajectory. The joint assembly includes a curl joint, a tilt joint; and a swivel structure. A work machine includes one or more processors to determine the first position of the working tool, to determine an active operating trajectory, to calculate a curl velocity and a tilt velocity such that the two velocities combine to move the working tool along the active operating trajectory, and to control the joint assembly to move the working tool according to the calculated velocities.

20 Claims, 8 Drawing Sheets

EXCAVATOR BUCKET CONTROL

FIELD OF THE DISCLOSURE

The present disclosure relates generally to self-propelled work vehicles such as construction and forestry machines, and more particularly to systems and methods for controlling joint assemblies to such machines wherein the joint assemblies have controllable movements with respect to one or more additional axes not found on the machines to which the joint assemblies are attached.

BACKGROUND

Self-propelled work vehicles of this type may, for example, include excavators, loaders, crawlers, motor graders, backhoes, forestry machines, front shovel machines, and others. Such work vehicles can typically have tracked ground engaging units supporting the undercarriage from the ground surface. Such work vehicles can further include a work implement, which includes one or more components, that is used to modify the terrain in coordination with movement of the work vehicle. The following discussion refers to the structure and operation of an excavator; however, the discussion also applies to other work vehicles (e.g., loaders, crawlers, motor graders, backhoes, forestry machines, front shovel machines, and others) having work implements.

An excavator can have an undercarriage that engages the terrain with ground engagement units (e.g., tracks) that are controllable to move the undercarriage forward and backward with respect to the terrain and to turn the undercarriage with respect to the terrain. A main frame is mounted on the frame via a swing bearing and can be rotated (swiveled) with respect to the undercarriage so that the frame can be positioned in different angular directions while the undercarriage remains in a fixed location. If, for example, the forward/backward motion and turning motion are considered to be motions in an XY plane defined by an X-axis and a Y-axis, the rotation can be considered to be motion about a Z-axis perpendicular to the XY plane. As discussed herein, the XY plane and the X-axis, Y-axis, and Z-axis are defined with respect to the undercarriage, which can be moving or resting with respect to terrain that may or may not be level.

The frame of the work vehicle (e.g., excavator) is the base for a work implement, which extends from the frame and is pivotable with respect to the frame. With respect to an excavator, the work implement can include a boom, an arm, and a working tool. The boom, arm, and working tool are linked together to form the work implement. For example, a first end portion of the boom can pivot about a first implement axis (e.g., a boom axis), which is fixed with respect to the frame. The boom has a second end portion that rotates angularly about the boom axis. The arm has a first end portion that can pivot about a second implement axis (e.g., an arm axis), which is fixed with respect to the second end portion of the boom. The arm has a second end portion that rotates angularly with respect to the arm axis. The working tool has a first end portion that can pivot about a third implement axis (e.g., a working tool axis), which is fixed with respect to the second end portion of the arm. The working tool has a "point-of-interest," which is the portion of the working tool that interacts with the terrain to modify the terrain. For example, in an exemplary excavator having a bucket as the working tool, the point-of-interest can be the tip of the bucket or the teeth extending from the tip of the bucket. In another example, the working tool can be a blade, and the point-of-interest can be the edge of the blade that moves dirt or other material. In another example, the working tool can be a jackhammer, and the point-of-interest can be the tip of the jackhammer.

The movements of the boom, the arm, and the working tool about the respective pivot axes are controlled by respective actuators. For example, a first (boom) actuator controls the rotation of the boom with respect to the frame. A second (arm) actuator controls the rotation of the arm with respect to the boom. A third (working tool) actuator controls the rotation of the working tool with respect to the arm. For example, the actuators can be hydraulic motors or hydraulic piston-cylinder units.

Historically, a skilled equipment operator positioned in a cab or other location in or on the frame manipulated control devices (e.g., levers) that selectively activated the actuators to cause the boom, the arm, and the working tool to be positioned such that the point-of-interest of the working tool is positioned in a desired location with respect to the terrain to be modified. The operator then manipulates the control devices further to cause one or more of the boom, the arm, and the working tool to rotate about the respective axes to cause the point-of-interest to modify the terrain proximate to the point-of-interest. For example, for the example of a bucket as the working tool, the boom and the arm can be caused to move the working tool closer to the frame as the tip (point-of-interest) of the bucket cuts or digs into the terrain to remove dirt or other material from the terrain. As the bucket moves closer to the frame, the bucket can also be rotated to control the depth of the tip of the bucket into the terrain. As described, the foregoing basic operation relies on the visual acuity and skill of the operator to control the positioning of tip of the bucket to create a desired modification to the terrain.

Recognizing the difficulty of manually monitoring and controlling the three-dimensional movement of the point-of-interest of the working tool of an excavator or other work vehicle, equipment manufacturers have automated the control of work vehicles. The work vehicles include control systems that monitor the angular positions of the components (e.g., the boom, the arm, and the working tool) with respect to the frame and also monitor the positions of the undercarriage and the frame with respect to the terrain to determine the location of the point-of-interest of the working tool with respect to a target location on the terrain. The control systems further include control algorithms that generate commands to the actuators of the boom, the arm, and the working tool to position the point-of-interest of the working tool accurately and to move the point-of-interest with precision to achieve a desired trajectory for the point-of-interest. For example, the point-of-interest can be controlled to accurately cut a surface to create a uniform grade between two locations on the terrain.

In addition to accurate information regarding the position and orientation of the undercarriage with respect to the target terrain, the functions of the control algorithms depend on accurate determinations of the relative positions of the boom, the arm, and the working tool with respect to each other and with respect to the frame. U.S. Pat. No. 11,873,621 to Kean for "System and Method for Tracking Motion of Linkages for Self-Propelled Work Vehicles in Independent Coordinate Frames" discloses a system and method using inertial measurement units (IMUs) positioned at selected locations on the frame, the boom, the arm, and the working tool to accurately determine the location and orientation of a working tool of an excavator or other work vehicle. U.S. Pat. No. 12,006,663 to Kean for "Calibrating Mounting Misalignments of Sensors on an Implement of a Work Machine Using Swing Motion" discloses a system and method for calibrating sensors on a work machine. U.S. Pat. Nos. 11,873,621 and 12,006,663 are incorporated herein by reference.

The systems and methods disclosed in U.S. Pat. No. 11,873,621 and 12,006,663 are effective to accurately determine the position of a point-of-interest of a conventional working tool that is pivotably connected to the arm such that the point-of-interest pivots around the working tool axis as described above. However, the movements of a conventional working tool are limited to the movements about the three pivot axes discussed above. A complex attachment between the arm of the work vehicle and a working tool provides additional pivotal and rotational freedoms of movement of the point-of-interest of the working tool around additional axes. A complex attachment can also provide linear movement. For example, a complex attachment implemented as a tilt/swivel complex attachment can be interposed between the arm of the work implement of an excavator and the bucket to provide tilting movement of the bucket about a tilt axis at the end of the arm and to provide rotational (swivel) movement. A first end portion of a tilt/swivel assembly can be attached to the working tool axis in place of a conventional bucket. A bucket or other working tool can be attached to a second end portion of the tilt/swivel assembly. The overall tilt/swivel assembly with the attached working tool is pivotable about the working tool pivot axis at the end of the arm such that the point-of-interest of the working tool moves arcuately in a first pivot plane as described above. The attached working tool is pivotable about a tilt/swivel assembly pivot axis such that the point-of-interest of the working tool moves arcuately in a second pivot plane. For example, the tilt/swivel assembly pivot axis can be at an angle to the working tool pivot axis such that the second pivot plane is oriented at an angle to the first pivot plane. The attached working tool is also rotatable about a swivel axis of the tilt/swivel assembly to cause the point-of-interest to move arcuately in a swivel plane. For example, the swivel axis can be at an angle to the working tool pivot axis and the tilt/swivel assembly pivot axis in the manner of a conventional three-axis coordinate system. The movements of the tilt/swivel assembly about the working tool pivot axis and the movements of the working tool about the tilt/swivel assembly pivot axis and about the swivel axis are combinable to move the point-of-interest of the working tool to multiple selectable locations in three dimensions. The respective rates of movement (e.g., angular velocities) of the point-of-interest are controllable so that the point-of-interest can follow a desired trajectory between any two locations.

As discussed above, the control system of a conventional work vehicle such as an excavator generates commands to various actuators to cause the undercarriage to move with respect to the terrain, to cause the frame to move (e.g., swivel) with respect to the undercarriage, and to cause the components of the work implement (e.g., the boom, the arm, and the working tool) to move with respect to the frame and with respect to each other. The control system can be programmed to respond to commands from an operator to optimize the movements requested by the operator. For some work vehicles, the control system may be programmed to perform autonomous operations. The control system receives feedback information from the sensors (e.g., the IMUs) to accurately control the trajectory of the point-ot-interest of the working tool.

Using the complex attachment, the working tool can be maneuvered to pivot at angles unattainable by conventional systems. The present disclosure discloses novel control functions implemented to achieve the desired accuracy and control of the working tool in these unconventional positions. These new control functions further enable the system to handle the increased complexity and precision desired for such advanced operations.

BRIEF SUMMARY

The current disclosure provides an enhancement to conventional systems, at least in part by introducing a novel work machine, control system, and method for controlling the complex arrangement and associated working tool.

In an exemplary embodiment, a work machine is disclosed. The work machine including a main frame; a work implement including a first end movably coupled to the main frame and a second end distal with respect to the main frame; a joint assembly coupled to the second end of the work implement; a working tool including a cutting edge, the working tool associated with the joint assembly, the joint assembly configured to actuate the working tool such that the working tool may be operable to move between a first working tool position and a second working tool position. The joint assembly includes a curl joint configured to enable the working tool to pivot about a curl axis. A tilt joint is configured to enable the working tool to pivot about a tilt axis. A swivel structure is configured to enable the working tool to rotate about a swivel axis. One or more processors are configured to determine the first position of the cutting edge relative to at least one of the main frame or the work implement and to determine an active operating trajectory to move the working tool between the first working tool position and the second working tool position, the active operating trajectory based on a vector normal to the first position of the cutting edge. The one or more processors are further configured to calculate a curl velocity of the working tool pivoting about the curl joint and to calculate a tilt velocity of the working tool pivoting around the tilt joint such that the two velocities combine to move the working tool along the active operating trajectory. The one or more processors are further configured to control the joint assembly to move the working tool according to the calculated curl and tilt velocities.

In some exemplary and optional aspects according to the above-referenced apparatus embodiment, the working machine further includes one or more sensors associated with the working tool and the joint assembly, wherein the one or more sensors are configured to determine at least a curl position, a tilt position, a swivel position, or any combination thereof of the working tool.

In some exemplary and optional aspects according to the above-referenced apparatus embodiment, the one or more processors are further configured to determine an instantaneous cutting edge position using the curl position, the tilt position, the swivel position, or any combination thereof.

In some exemplary and optional aspects according to the above-referenced apparatus embodiment, the working machine further includes a sensor associated with the working tool and configured to determine one or more of a pitch, roll, or yaw of the working tool.

In some exemplary and optional aspects according to the above-referenced apparatus embodiment, the one or more processors are further configured to determine an instantaneous cutting edge position using one or more of the pitch, the roll, or the yaw of the working tool.

In some exemplary and optional aspects according to the above-referenced apparatus embodiment, the one or more processors are further configured to receive a control input to move the working tool between the first working tool position and the second working tool position.

In some exemplary and optional aspects according to the above-referenced apparatus embodiment, the one or more processors are further configured to control the joint assembly to move the working tool according to the calculated curl and tilt velocities in response to the control input.

In some exemplary and optional aspects according to the above-referenced apparatus embodiment, calculating the velocity of the joint assembly further includes calculating a ratio of the curl and tilt velocities to determine a joint assembly velocity.

In some exemplary and optional aspects according to the above-referenced apparatus embodiment, each of the first working tool position and the second working tool position includes a respective curl component, a respective tilt component, and a respective swivel component.

In some exemplary and optional aspects according to the above-referenced apparatus embodiment, the joint assembly may be configured to connect the work implement to the curl joint and the working tool to the swivel structure.

In another embodiment, a computer-implemented method of controlling a working tool of a work machine is disclosed. The method comprises determining a first cutting edge position of a cutting edge of the working tool relative to at least one of a main frame or a work implement coupled to the main frame. The working tool is further coupled to the work implement by a joint assembly. The method further comprises determining an active operating trajectory of the working tool based on a vector normal to the first position of the cutting edge wherein the active operating trajectory of the working tool moves the working tool along a desired path between a first working tool position and a second working tool position calculating a joint assembly velocity. The joint assembly velocity includes a curl component and a tilt component. The joint assembly velocity is configured to move the working tool based on the active operating trajectory. The method further includes controlling the joint assembly to move the working tool from the first working tool position to the second working tool position according to the calculated joint assembly velocity.

In some exemplary and optional aspects according to the above-referenced method embodiment, determining the working tool position further includes determining the working tool position using a curl position, a tilt position, a swivel position, or any combination thereof of the working tool determined by one or more sensors associated with the working tool and the joint assembly.

In some exemplary and optional aspects according to the above-referenced method embodiment, determining the working tool position further includes determining the working tool position using one or more of a pitch, a roll, or a yaw of the working tool determined by one or more sensors associated with the working tool.

In some exemplary and optional aspects according to the above-referenced method embodiment, the method further includes receiving a control input to move the working tool between the first working tool position and the second working tool position.

In some exemplary and optional aspects according to the above-referenced method embodiment, the method further includes controlling the joint assembly to move the working tool according to the calculated joint assembly velocity in response to the control input.

In some exemplary and optional aspects according to the above-referenced method embodiment, wherein the control input includes a speed at which to move the working tool.

In some exemplary and optional aspects according to the above-referenced method embodiment, the method further includes moving the working tool from an initial working tool position to the first working tool position before moving the working tool from the first working tool position to the second working tool position along the operating trajectory.

In some exemplary and optional aspects according to the above-referenced method embodiment, calculating the joint assembly velocity further includes calculating a ratio of the curl component and the tilt components of the joint assembly velocity.

In some exemplary and optional aspects according to the above-referenced method embodiment, each of the first working tool position and the second working tool position includes a curl component, a tilt component, and a swivel component.

In some exemplary and optional aspects according to the above-referenced method embodiment, the joint assembly includes a curl joint to enable the working tool to pivot about a curl axis, a tilt joint to enable the working tool to pivot about a tilt axis, and a swivel structure to enable the working tool to rotate about a swivel axis.

DETAILED DESCRIPTION

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment. Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

As illustrated in FIGS. 1-11, various embodiments are described herein with respect to systems and methods for controlling a working tool 146 of a work vehicle 120 attached to a work implement 140 by a complex attachment 350. The work vehicle 120 may include construction machines, agricultural machines, and other types of heavy machinery. For example, the work vehicle 120 may be an excavator machine, backhoe, front shovel machine, or any other relevant machine.

Figure 1:
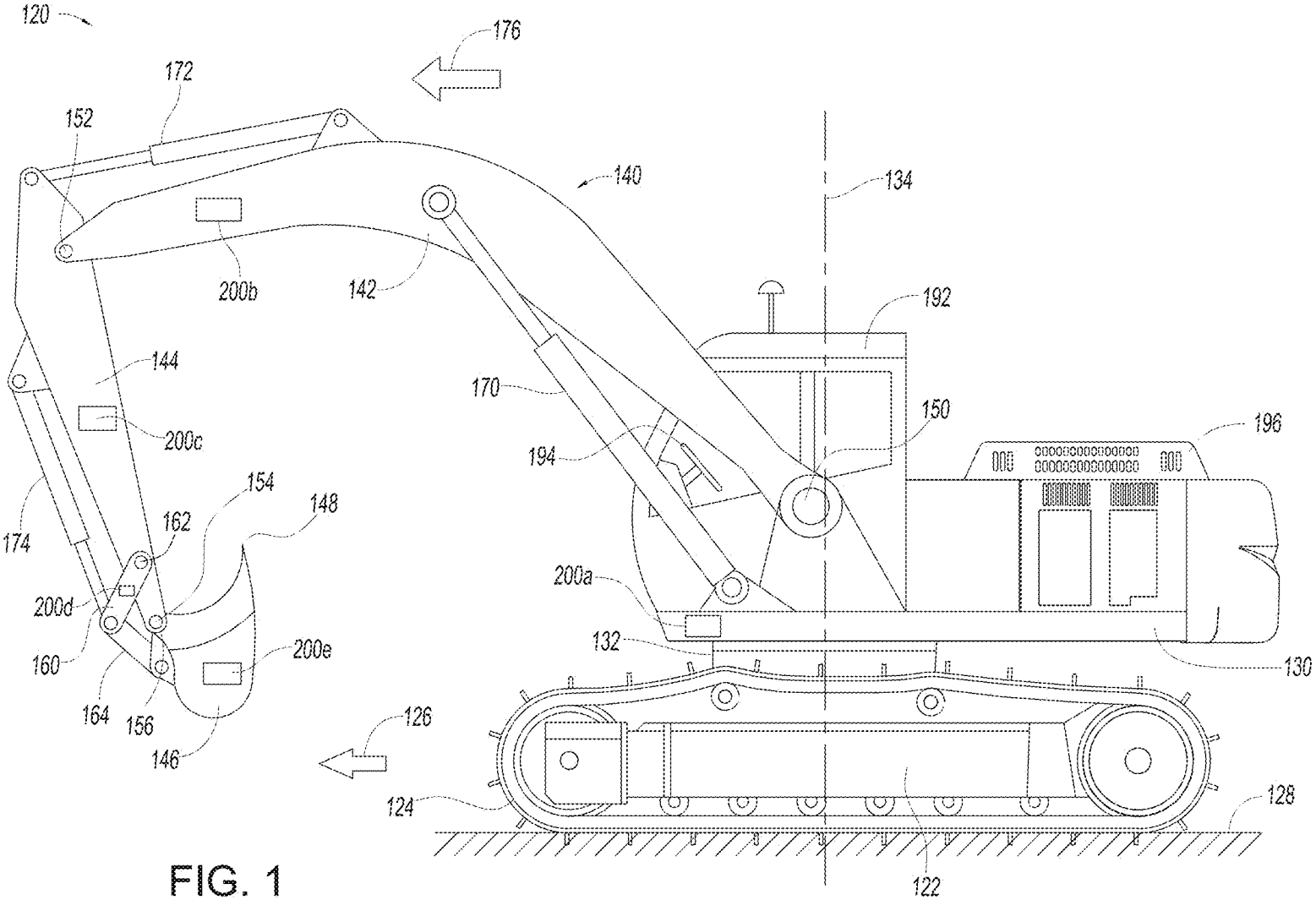
FIG. 1 is a side elevation view representing an excavator as an exemplary self-propelled work vehicle according to an embodiment of the present disclosure.

FIG. 1 illustrates an embodiment of a work vehicle 120 as an excavator machine. The work vehicle 120 includes an undercarriage 122, which includes first and second ground engaging units 124 (e.g., tracks). Only one of the ground engaging units 124 is shown in FIG. 1. The other ground engaging unit 124 is parallel to the illustrated ground engaging unit 124. The undercarriage 122 includes respective first and second travel motors (not shown) for driving the first and second ground engaging units 124. The ground engaging units 124 can be driven at the same velocity to move the undercarriage 122 forward (e.g., in a forward direction indicated by an arrow 126) or backward (e.g., in a direction opposite the arrow 126) with respect to underlying terrain 128 (e.g., ground or other material supporting the undercarriage 122). The ground engagement units 124 can also be driven at different velocities to enable the undercarriage 122 to turn with respect to the terrain at an angle with respect to the forward direction represented by the arrow 126.

A main frame 130 is supported from the undercarriage 122 by a swing bearing 132 such that the main frame 130 is pivotable about a main frame pivot axis 134 relative to the undercarriage 122. The pivot axis is substantially vertical when the underlying ground terrain 128 engaged by the ground engaging units 124 is substantially horizontal. (In the discussion herein, "horizontal" and "vertical" are referenced to a plane defined by the ground engaging units 124.) A swing motor (not shown) is configured to pivot the main frame on the swing bearing about the pivot axis relative to the undercarriage 122.

In the illustrated embodiment wherein the work vehicle 120 is an excavator, a work implement 140 extends from the main frame 130. In FIG. 1, the work implement 140 is configured as a boom assembly. The work implement includes conventional components in the form of a boom 142, an arm 144, and a working tool 146. The working tool 146 includes a point-of-interest (POI) 148, which engages portions of terrain (or other materials) to be moved or removed. The working tool 146 further includes a cutting edge 198 for cutting into the work surface. The cutting edge 198 may be used to grade the work surface, dig into the work surface, or other earth moving functions. The cutting edge 198 is the leading edge of the working tool 146 that cuts into the work surface. Some embodiments, such as an excavator bucket, often include claw-like structures. In such embodiments, the cutting edge 198 can be the effective leading edge created by the claw-like structures.

The boom 142 is pivotally connected to the main frame 130 by a boom-to-frame linkage joint 150, which provides a horizontal pivot axis for the boom. The arm 144 is pivotally connected to the boom 142 at an arm-to-boom linkage joint 152. In the illustrated embodiment, the working tool 146 is an excavator shovel, which is pivotally connected to the arm 144 at a working tool-to-arm linkage joint 154, which is positioned near a free end 156 of the arm. In the illustrated embodiment, a first end of a dogbone connector 160 is pivotally connected to the arm 144 at a dogbone-to-arm linkage joint 162, which is displaced from the free end of the arm 144. A second end of the dogbone connector is pivotally connected to a tool link 164. In the context of the illustrated (excavator) work vehicle 120, the tool link is a bucket link.

The boom 142 is caused to move pivotally with respect to the main frame 130 by a boom actuator 170. The boom actuator can be a hydraulic motor. In the illustrated embodiment, the boom actuator is a hydraulic piston-cylinder unit that is selectively provided with pressurized hydraulic fluid to move the piston within the cylinder to extend or extract the piston. The pressurized hydraulic fluid is provided by a hydraulic system (not shown) and is controlled by manual controls, automatic controls, or a combination of manual and automatic controls. In a similar manner, the arm 144 is caused to pivot with respect to the boom 142 by an arm actuator 172. The working tool (bucket) 146 is caused to pivot with respect to the arm 144 by a working tool actuator 174 acting on the working tool via the dogbone connector 160, the dogbone-to-arm linkage joint 162, and the tool link 164.

The work implement 140 extends from the main frame 130 along a working direction (represented by an arrow 176) of the work implement. In FIG. 1, the working direction is referenced to the main frame. Although illustrated as parallel to the forward direction (arrow 126) of the undercarriage 122, the working direction can be at an angle to the forward direction depending on the rotational position of the main frame 130 with respect to the undercarriage 122. The working direction can also be described as a working direction of the boom 142. As illustrated schematically in FIG. 2, the working direction can be considered to be in an operational plane 180 (represented in phantom lines). The boom-to-frame linkage joint 150 defines a first pivot axis 182. The arm-to-boom linkage joint 152 defines a second pivot axis 184. The working tool-to-arm linkage joint 154 defines a third pivot axis 186 (which can also be referred to as a curl joint and a curl axis, respectively). The three pivot axes are perpendicular to the operational plane. In embodiments involving a bucket or other carrying mechanism, the third pivot axis 186 enables the working tool 146 to move between a curl position and a dump position to perform a curl and dump operation. This operation can be used for the working tool 146 to cut or dig into the working surface to collect material or can allow the bucket to dump material already carried in the bucket.

As described herein, control of the work implement 140 relates to controlling the positioning of any one or more of the associated components (e.g., the boom 142, the arm 144, and the working tool 146) to control the movement of the point-of-interest 148 of the working tool with respect to material being manipulated (e.g., the material to be moved or removed).

Figure 2:
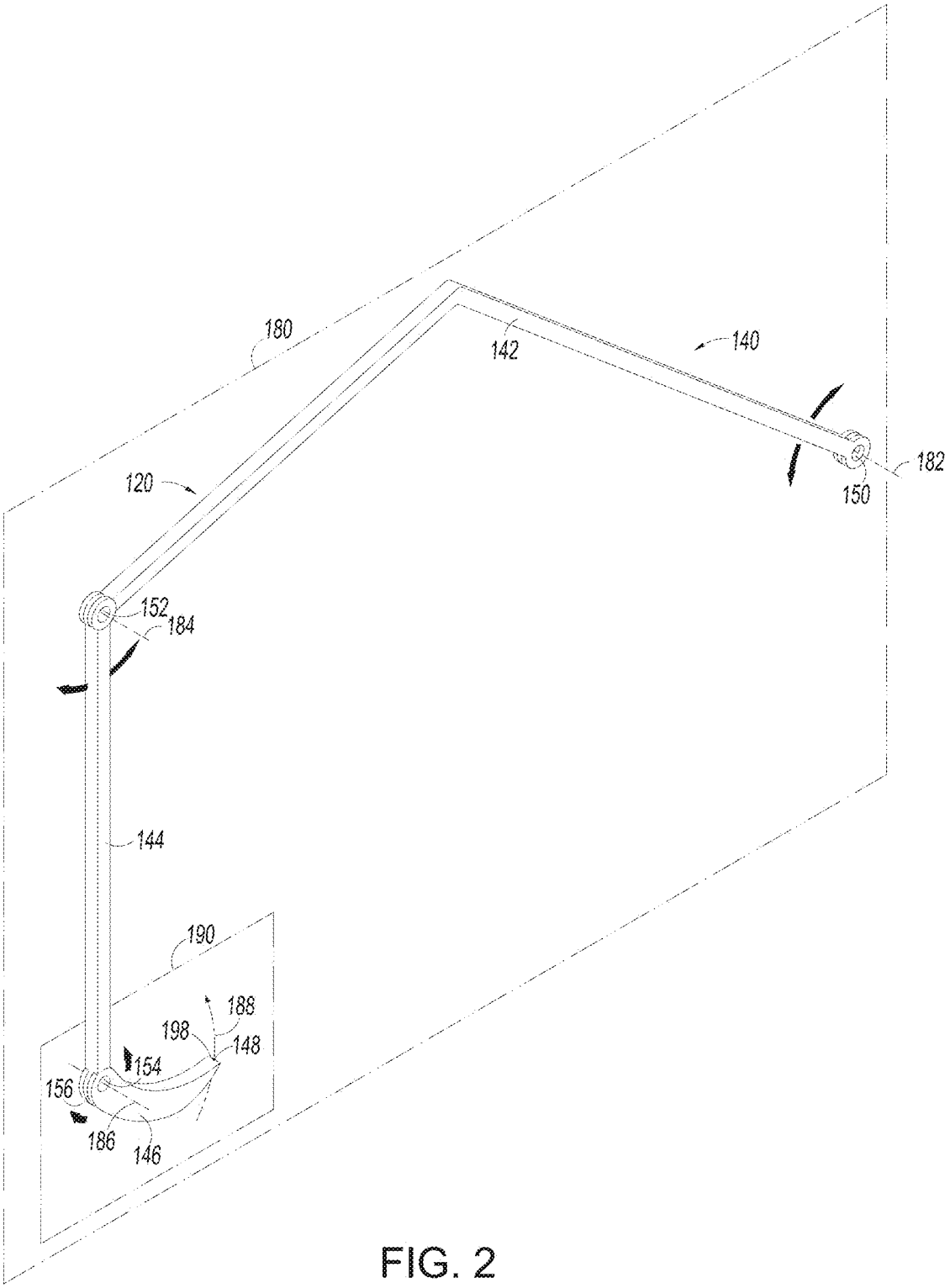
FIG. 2 is a schematic representation of the components of the work implement of the work vehicle of FIG. 1 showing the pivoting movements of components with respect to each other.

As illustrated by curved arrows in the schematic representation of FIG. 2, the actuators 170, 172, 174 (FIG. 1) of the work implement 140 can be selectively actuated to pivotally move the boom 142 with respect to the respective boom-to-frame linkage joint 150, to pivotally move the arm 144 with respect to the arm-to-boom linkage joint 152, and to pivotally move the working tool 146 with respect to the working tool-to-arm linkage joint 154. By coordinating the movements of the boom 142, the arm 144, and the working tool 146 of the work implement 140, the point-of-interest 148 of the working tool engages and acts upon the material to be manipulated along a selected trajectory 188 at a target velocity. The selected trajectory 188 can be curved as shown (e.g., by pivoting the working tool about the working tool-to-arm linkage joint 154 or by pivoting the arm 144 about the arm-to-boom linkage joint 152). The selected trajectory 188 can also be linear by coordinating the pivoting of the boom 142, the arm 144, and the working tool 146 using inverse kinematic techniques or other suitable techniques (e.g., open loop modeling) to determine the respective pivotal velocities of the three components of the work implement 140. It should be understood that the point-of-interest 148 moves within a point-of-interest plane 190, which is encompassed with the operational plane 180 discussed above.

In the illustrated embodiment, an operator's cab 192 is located on the main frame 130. In the illustrated embodiment, the operator's cab and the work implement 140 are both mounted on the main frame 130 so that the operator's cab faces in the working direction (arrow 176) of the work implement 140. In the illustrated embodiment, a control station 194 is located in the operator's cab.

The main frame 130 also supports an engine 196 for powering the work vehicle 120. The engine can be a diesel internal combustion engine or another source of power. In the illustrated embodiment, the engine drives at least one hydraulic pump (not shown) to provide hydraulic power to the various operating systems of the work vehicle.

In the illustrated embodiment, a sensor system 200 (see FIG. 3) is mounted on the work vehicle 120. As illustrated in FIG. 1, the sensor system 200 includes a first sensor 200*a* mounted to the main frame 130, a second sensor 200*b* mounted to the boom 142, a third sensor 200*c* mounted to the arm 144, a fourth sensor 200*d* mounted to the dogbone connector 160, and a fifth sensor 200*e* mounted to the working tool 146. In the illustrated embodiment, each of the first through fifth sensors is an inertial measurement unit (IMU). IMUs are tools that capture a variety of motion-based and position-based measurements, including, but not limited to, velocity, acceleration, angular velocity, and angular acceleration.

An accelerometer is an electro-mechanical device or tool used to measure acceleration (e.g., in meters per seconds squared ($m/s^2$)), which is defined as the rate of change of velocity (e.g., in meters per second (m/s)) of an object. Accelerometers sense either static forces (e.g., gravity) or dynamic forces of acceleration (e.g., vibration and movement). An accelerometer can include sense elements measuring the force due to gravity. By measuring the quantity of static acceleration due to gravity of the Earth, an accelerometer may provide data as to the angle the object is tilted with respect to the Earth, the angle of which may be established in an x-axis, y-axis, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth. A gyroscope is a device used to measure changes in orientation, based upon the object's angular velocity (rad/s) or angular acceleration ($rad/s^2$). A gyroscope may constitute a mechanical gyroscope, a micro-electro-mechanical system (MEMS) gyroscope, a ring laser gyroscope, a fiber-optic gyroscope, and/or other gyroscopes as are known in the art. Principally, a gyroscope is employed to measure changes in angular position of an object in motion, the angular position of which may be established in an x-axis, y-axis, and z-axis coordinate frame.

Figure 3:
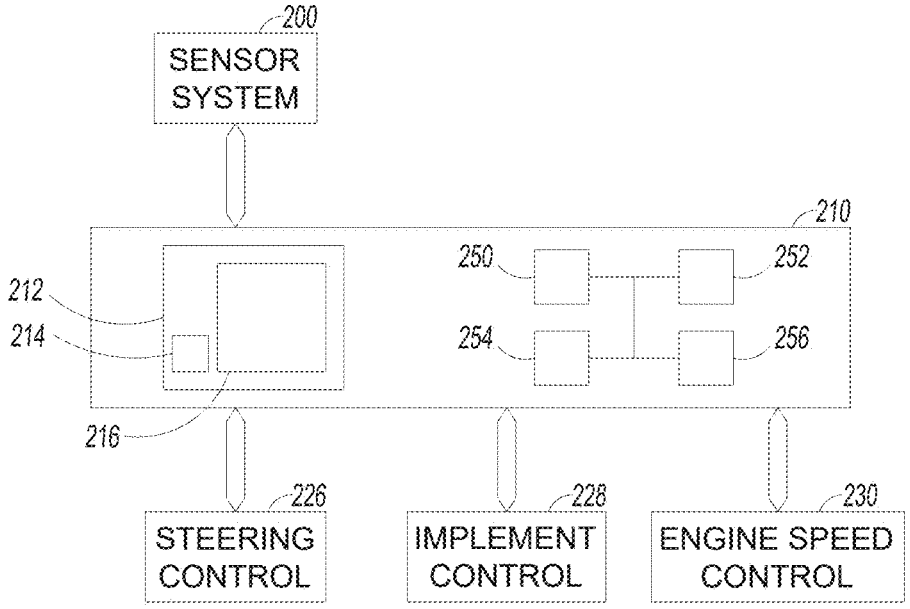
FIG. 3 is a schematic representation of a machine control system for the work vehicle of FIG. 1.

As schematically illustrated in FIG. 3, the self-propelled work vehicle 120 includes a control system that includes a machine controller 210. The machine controller 210 can be part of the machine control system of the working machine, or it can be a separate machine control module. The machine controller 210 is optionally mounted in the operator's cab 192 at the control station 194. The machine controller 210 can include a user interface 212 such as a control panel. The user interface can include a user interface tool 214 such as an input/output device (e.g., a keyboard, a joystick, or the like.) The user interface 212 can also include a display 216.

The machine controller 210 is configured to receive input signals from some or all of various sensors 200*a* . . . 200*e* collectively defining the sensor system 200. The sensors of the sensor system may typically be discrete in nature, but signals representative of more than one input parameter may be provided from the same sensor. The sensor system can also refer to signals provided from the machine control system.

IMUs include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, as discussed above, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, to produce local information and coordinates on the position, motion, and orientation of the IMU.

The machine controller 210 can be configured to produce outputs to the user interface 212 for displaying information to the human operator. In addition, or in the alternative, the machine controller 210 can be configured to generate control signals for controlling the operation of respective actuators, or generate signals for indirect control via intermediate control units, associated with a machine steering control system 226, a machine implement control system 228, and an engine speed control system 230. The machine controller 210 can generate control signals for controlling the operation of various actuators, such as hydraulic motors or hydraulic piston-cylinder units of the boom actuator 170, the arm actuator 172, and the working tool actuator 174. The control signals from the controller can be received by electro-hydraulic control valves associated with the actuators such that the electro-hydraulic control valves control the flow of hydraulic fluid to and from the respective hydraulic actuators to control the actuation thereof in response to the control signal from the controller.

In the illustrated embodiment, the machine controller 210 includes, or is associated with, a processor 250, a computer-readable medium 252, a communication unit 254, data storage 256 such as for example a database network, and the aforementioned user interface (control panel) 212 having the display 216 and the user interface tool (e.g., input/output device) 214 by which a human operator may input instructions to the controller. The machine controller 210 described herein may be a single controller having all of the described functionality, or it may include multiple machine controllers wherein the described functionality is distributed among the multiple controllers. The data storage may generally encompass hardware such as volatile or non-volatile storage devices, drives, memory, or other storage media, as well as one or more databases residing thereon.

Various "computer-implemented" operations, steps or algorithms as described in connection with the controller 210 or in connection with alternative but equivalent computing devices or systems can be embodied directly in hardware, in a computer program product such as a software module executed by the processor 250, or in a combination of the two. The computer program product can reside in RAM memory, flash memory, ROM memory, EPROM memory, EEPROM memory, registers, hard disk, a removable disk, or any other form of computer-readable medium 252 known in the art. An exemplary computer-readable medium 252 can be coupled to the processor 250 such that the processor 250 can read information from, and write information to, the memory/storage medium 252. In the alternative, the computer-readable medium 252 can be integral to the processor 250. The processor 250 and the computer-readable medium 252 can reside in an application specific integrated circuit (ASIC). The ASIC can reside in a user terminal. In the alternative, the processor 250 and the medium 252 can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices (e.g., a combination of a digital signal processor (DSP) and a microprocessor), a plurality of microprocessors, one or more microprocessors in conjunction with a DSP core, or any other such configuration.

The communication unit 254 can support or provide communications between the machine controller 210 and external systems or devices, and/or support or provide communication interface with respect to internal components of the self-propelled work vehicle 120. The communications unit 254 can include wireless communication system components (e.g., via cellular modem, Wi-Fi® systems, Bluetooth® systems, or the like) and/or may include one or more wired communications terminals such as universal serial bus ports.

Figure 4:
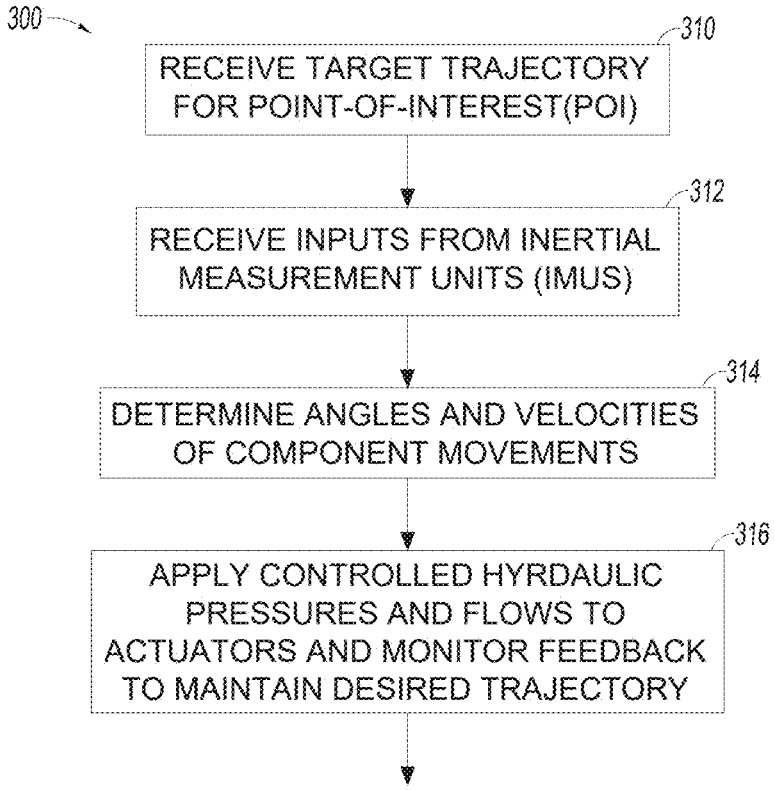
FIG. 4 illustrates a flowchart of an exemplary embodiment of a method for tracking motion of linkage joints for the self-propelled work vehicle of FIG. 1 to achieve a desired trajectory for the point-of-interest of a working tool.

FIG. 4 illustrates a flowchart of an exemplary embodiment of a method 300 for tracking motion of linkage joints for the self-propelled work vehicle 120 to achieve a desired trajectory (e.g., the selected trajectory 188 in FIG. 2) for the point-of-interest 148. In a first step 310, the method receives the target trajectory for moving the point-of-interest. For example, the target trajectory can be a predetermined target trajectory that forms a portion of an overall terrain forming (e.g., excavation) plan. In a second step 312, the method receives inputs from the above-described IMUs 200*a*, 200*b*, 200*c*, 200*d*, 200*e*, and the method determines a current (or instantaneous) location of the point-of-interest and/or cutting edge. In a third step 314, the method uses inverse kinematics or other suitable techniques to determine various angles and pivoting velocities of the components of the work implement 140 to achieve the target velocity of the point-of-interest 148. In a fourth step 316, the method applies controlled hydraulic pressures to the actuators 170, 172, 174 to move the boom 142, the arm 144, and the working tool 146 to achieve the determined angles and pivoting velocities. In the fourth step 316, the method receives feedback from the IMUs, which enables the method to adjust the hydraulic pressures as needed to maintain the desired trajectory.

As described above, the work vehicle 120 and the method 300 enable the point-of-interest 148 of the working tool 146 to be moved along a desired trajectory (e.g., the selected trajectory 188 of FIG. 2). Because of the positions of the disclosed pivot axes 182, 184, 186 at the joints 150, 152, 154, the point-of-interest 148 is only able to move in the point-of-interest plane 190 perpendicular to the pivoting axes and parallel to the working direction (arrow 176). Thus, the trajectory of the point-of-interest 148 is in the point-of-interest plane 190 as shown in FIG. 2.

Figure 5:
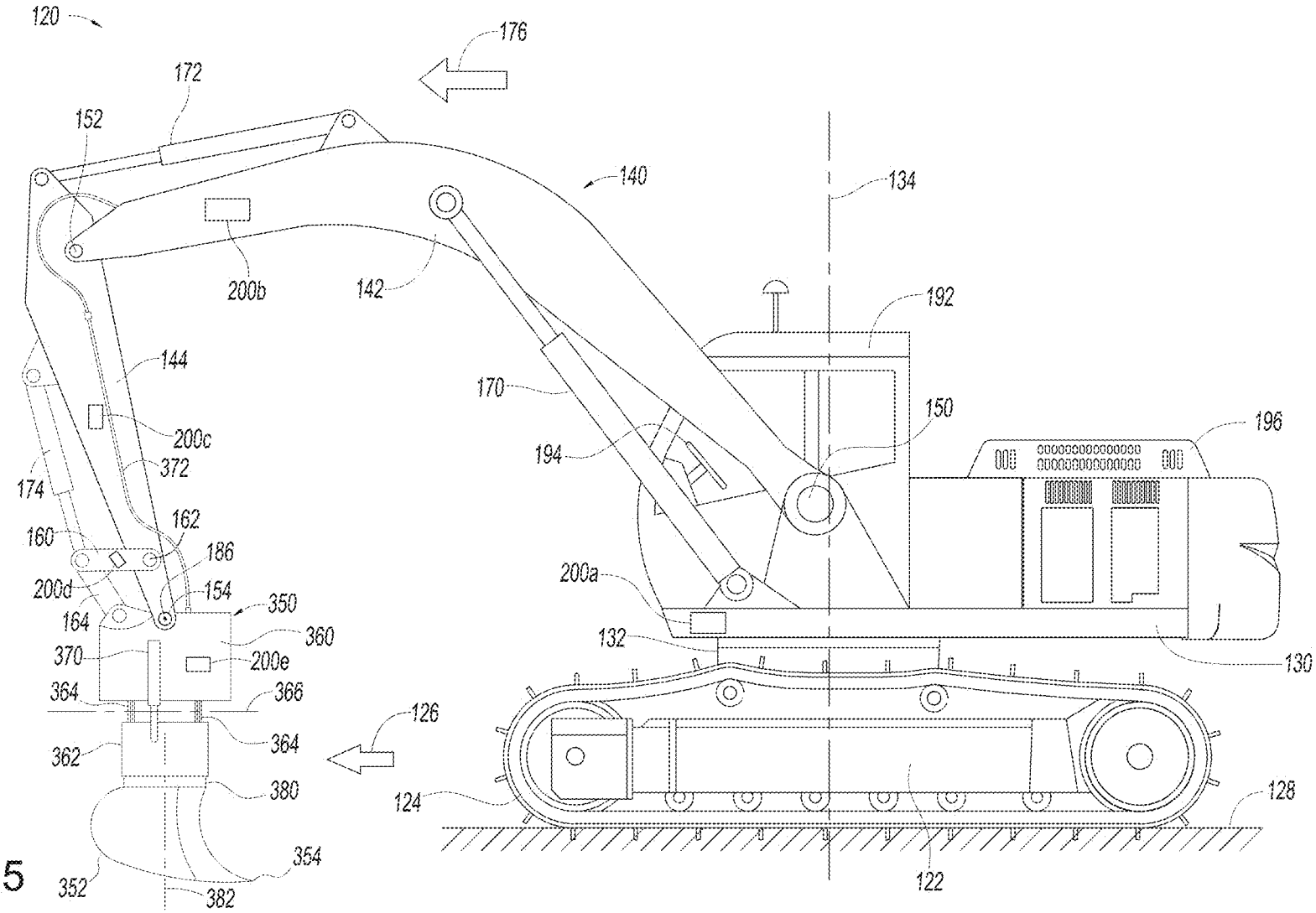
FIG. 5 illustrates the work vehicle of FIG. 1 equipped with a complex attachment that enables the point-of-interest of the working tool to move in at least one additional degree of freedom.

FIG. 5 illustrates the work vehicle 120 of FIG. 1 equipped with a complex attachment 350 that enables a point-of-interest 354 of a working tool 352 to move in at least one additional degree of freedom. The working tool 352 further includes a cutting edge 356 for cutting into the work surface. The complex attachment 350, the working tool-to-arm linkage joint 154, and associated mechanisms can be referred to collectively as a joint assembly. In the illustrated example of the work vehicle as an excavator, the working tool is an excavator bucket as previously described. A first (upper) portion 360 of the complex attachment is pivotally mounted to the arm 144 at the working tool-to-arm linkage joint 154 in place of the conventional bucket working tool 146. Accordingly, the overall complex attachment is pivotally movable about the third pivot axis 186 (shown as an end dot in FIG. 5) of the working tool-to-arm linkage joint 154 using the working tool actuator 174. The fifth sensor 200*e* is mounted to the first portion of the complex attachment to enable the machine controller 210 to monitor the movement of the complex attachment about the third pivot axis.

As further shown in FIG. 5, a second (lower) portion 362 of the complex attachment 350 is pivotally attached to the first (upper) portion 360 of the complex attachment via an integral complex attachment linkage joint 364, which comprises two pivot brackets in the illustrated embodiment. The integral complex attachment linkage joint enables the second portion to pivot (e.g., tilt) with respect to the first portion about a tilt axis 366, which is perpendicular to the third pivot axis 186, thus providing a first additional degree of freedom (tilting).

The first (upper) portion 360 of the complex attachment 350 supports at least one hydraulic actuator 370, which is coupled to the second (lower) portion 362. The hydraulic actuator is selectively activated by an internal control system (not shown in FIG. 5) of the complex attachment to tilt the second portion with respect to the first portion about the tilt axis 366. The complex attachment receives hydraulic fluid from the work vehicle 120 via at least one hydraulic supply line 372. The complex attachment selectively directs the volume and pressure of the hydraulic fluid to the actuator.

The second (lower) portion 362 of the complex attachment 350 includes a tool support structure 380 that is rotatable with respect to the second portion about a rotation axis 382 (or swivel axis). The tool support structure is rotated by an internal hydraulic motor 384 (FIG. 7) within the second portion of the complex attachment. The working tool 352 is attached to the tool support structure and rotates with the tool support structure. Thus, the rotation of the tool support structure provides a second additional degree of freedom of movement of the working tool. Although the working tool is illustrated as being an integral part of the complex attachment, the working tool can be removed and replaced with a replacement working tool such as a different-sized excavator bucket. The replacement working tool can be different type of working tool such as a blade.

Figure 6:
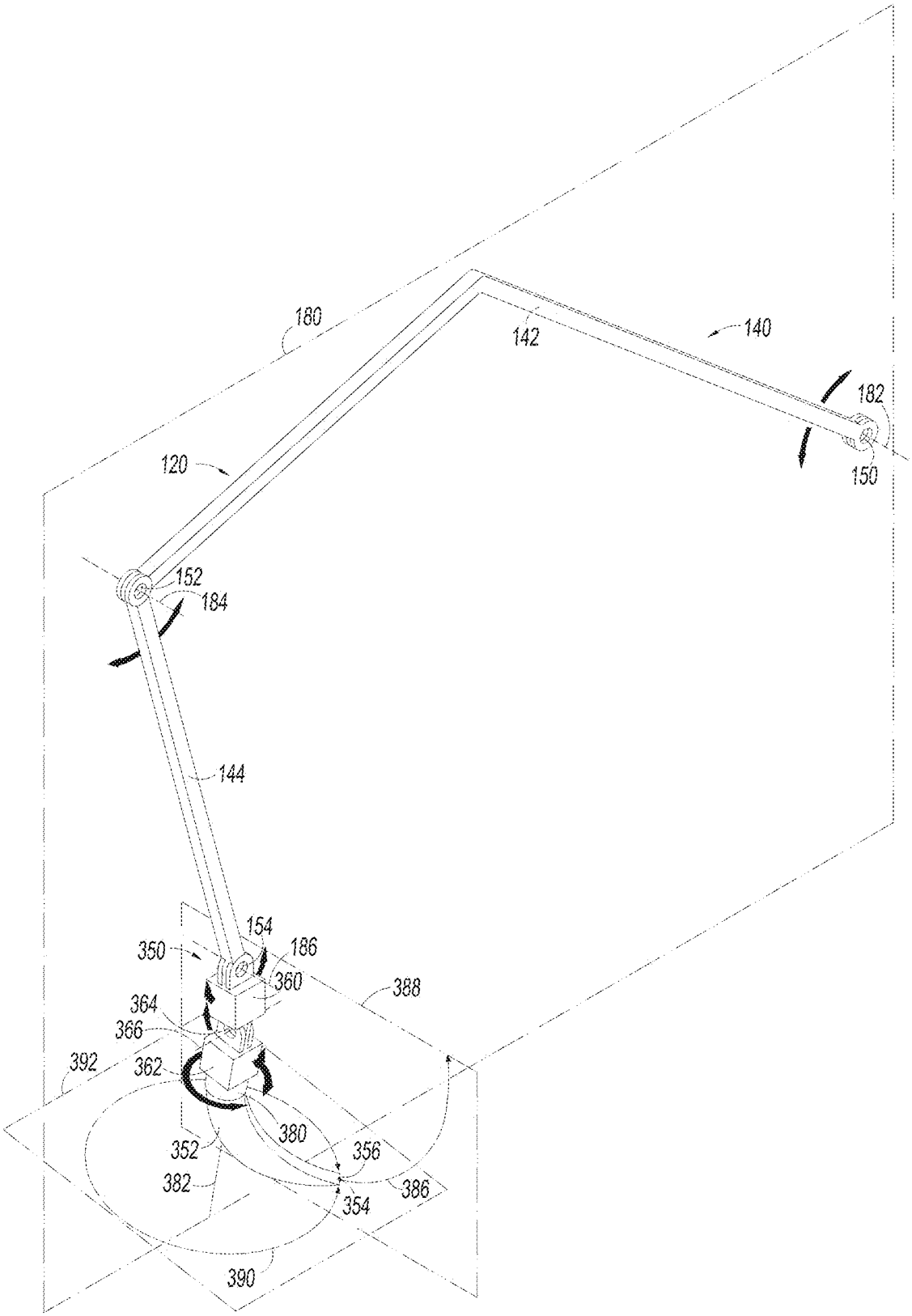
FIG. 6 is a schematic representation of the components of the work implement of the work vehicle of FIG. 5 with a complex attachment, which representation is similar to the schematic representation of FIG. 2, and which further shows the pivoting and swiveling (rotation) of the working tool with respect to the end of the work implement.

The effect of the complex attachment 350 is illustrated schematically in FIG. 6, which is similar to the schematic illustration of FIG. 4, wherein the operational plane 180 and the three pivot axes 182, 184, 186 of the work implement 140 are represented and numbered accordingly. FIG. 6 further illustrates a representation of the first (upper) portion 360, the second (lower) portion 362 of the complex attachment 350 and the tool support structure 380. As illustrated, the second portion can tilt about the tilt axis 366 of the integral complex attachment linkage joint 364 (also referred to as the tilt joint) to cause the point-of-interest 354 of the working tool 352 to have a tilt trajectory (tilt velocity) 386 in a tilt plane 388, which is perpendicular to the tilt axis 366. As further illustrated, the tool support structure and the attached working tool can rotate with respect to the second portion about the rotation axis 382 to cause the point-of-interest to have a rotation trajectory (rotation velocity) 390 in a rotation plane 392, which is perpendicular to the rotation axis 382.

Each of the tilt trajectory 386 and the rotation trajectory 390 has a respective trajectory path about the respective tilt axis 366 and the respective rotation axis 382 as illustrated in FIG. 6. Each trajectory has a respective angular velocity along the respective trajectory path. Accordingly, as used herein, the "tilt trajectory" and the "rotation trajectory" are used interchangeably with the respective angular velocities about the respective tilt axis and rotation axis. A person of skill in the art will also appreciate that "rotation" may also be referred to as "swivel."

In FIG. 6, the pivot trajectory 386 and the rotation trajectory 390 are each illustrated when only one of either pivotal movement or rotational movement occurs from the illustrated location of the point-of-interest. When the complex attachment 350 applies velocities to cause pivotal movement and rotational movement to occur simultaneously, the resulting active operating trajectory 550 will not be confined to either of the illustrated planes and will have a complex movement resulting from the selected velocities of the two movements. A more complex trajectory can be produced by applying pivotal movement about one or more of the pivot axes 182, 184, 186 of the work implement 140 in coordination with the tilt and rotation movements of the complex attachment 350.

The complex attachment 350 includes an internal control system (attachment controller) 400 (FIG. 7) that controls the at least one hydraulic actuator 370 (FIG. 5) to pivot the second (lower) portion 362 with respect to the first(upper) portion 360 and that controls the internal hydraulic motor 384 (FIG. 7) to rotate the working tool support structure 380 and the attached working tool 352 with respect to the second portion. The complex attachment 350 receives commands from the machine controller 210 (FIG. 3) of the work vehicle 120. Rather than commanding the rotation of the second portion and the pivoting of the working tool directly, the desired velocities tilt and rotate velocities are sent from the machine controller of the work vehicle to the internal control system of the complex attachment to instruct the complex attachment to move the point-of-interest 354 of the working tool with respect to the working tool-to-arm linkage joint 154 to which the complex attachment is pivotally attached. The internal control system of the complex attachment determines how to manipulate the actuators (not shown) of the complex attachment to achieve the desired movement. Thus, the machine controller of the work vehicle does not have to generate actuator controls for the complex attachment. The complex attachment provides feedback to the machine controller of the work vehicle so that the machine controller is able to verify that the complex attachment has rotated and tilted the point-of-interest as requested. The complex attachment also sends requests to the machine controller of work vehicle to identify the hydraulic pressure needed to actuate the actuators (not shown) of the complex attachment to achieve the desired movement of the point-of-interest in the tilt plane 388.

Figure 7:
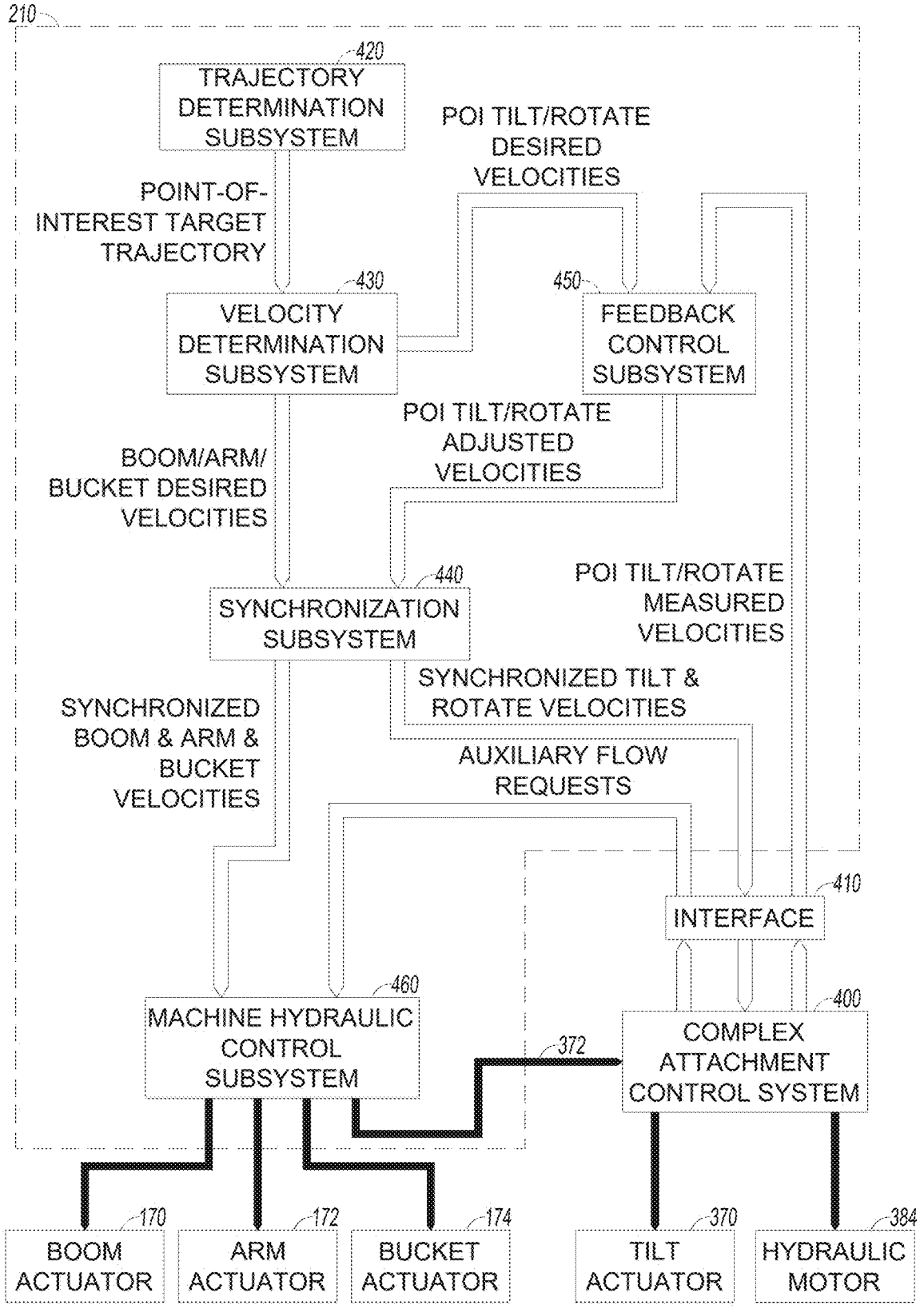
FIG. 7 illustrates a block diagram of an overall system that includes a machine control system in communication with a complex attachment control system.

As discussed above, the machine controller 210 of the work vehicle 120 does not control the actuators of the complex attachment directly. Rather, as illustrated in FIG. 7, the machine controller of the work vehicle communicates with internal control system (attachment controller) 400, which is located within the complex attachment 350. Various communications protocols can be used to communicate between the machine controller and the attachment control system via an interface 410. As described below, the machine controller includes additional algorithms to determine desired positions and movements of the complex attachment; however, the machine controller does not have to include algorithms to directly monitor and control the rotational movement of the complex attachment or the pivoting movement of the working tool 352 with respect to the complex attachment.

In the embodiment illustrated in FIGS. 5 and 6, the sensor system 200 can be associated with the joint assembly and working tool 352 and configured to determine the curl position, the tilt position, the swivel position, or any combination thereof. The sensor system 200 can also be configured to determine the pitch, roll, yaw, or any combination thereof of the working tool. The sensor system 200 can also be configured to detect any other position, orientation, or any component thereof for the joint assembly and working tool that may occur to a person of skill in the art. Further, the sensor system can be configured to determine the instantaneous value of each of these determined positions, orientations, or components thereof.

As further shown in FIG. 7, the subsystems of the machine controller 210 pertinent to this disclosure includes a trajectory determination subsystem 420 that determines a target velocity for the point-of-interest 354 based on the currently known position of the point-of-interest (also referred to as the instantaneous position of the point of interest) and based on a desired movement of the point-of-interest with respect to the terrain to be manipulated. The trajectory determination subsystem 420 may alternatively utilize the cutting edge 356 rather than the point-of-interest 354. Because of the complex attachment 350, the desired movement of the point-of-interest is not limited to movement in the operational plane 180. Instead, the movement can include movement in a different plane (e.g., movement in the tilt plane 388 discussed above).

The target velocity determined by the trajectory determination subsystem 420 is provided as an input to a velocity determination subsystem 430. The velocity determination subsystem performs a modeling technique such as an inverse kinematic determination based on the target velocity to determine a desired boom pivot velocity, a desired arm pivot velocity, and a desired bucket pivot velocity. As described herein, the working tool (bucket) 146 of FIG. 1 is replaced with the complex attachment 350 with the working tool 352 coupled to the complex attachment. Accordingly, the desired bucket velocity determines the tilt location and velocity of the first (upper) portion 360 of the complex attachment 350 with respect to the arm 144. The velocity determination subsystem also determines a desired second portion rotation location and velocity of the second (lower) portion 362 of the complex attachment 350 with respect to the first portion 360 of the complex attachment. The tilt determination establishes the orientation and movement of the tilted rotation plane 392 (FIG. 6). The rotation determination establishes the orientation and movement of the tilt plane 388. The velocity determination subsystem also determines velocities of the point-of-interest 354 within the two planes The desired boom velocity, the desired arm velocity and the desired bucket velocity determined by the velocity determination subsystem 430. In the illustrated embodiment, the desired boom, arm, and bucket velocities are provided as inputs to a synchronization subsystem 440, which operates as described below. The desired tilt velocity of the second (lower) portion 362 of the complex attachment 350 and the desired rotation velocity of the point-of-interest 354 determined by the second machine control subsystem are provided as inputs to a feedback control subsystem 450.

The feedback control subsystem 450 receives measured velocities reported by the attachment controller 400. A measured second portion tilt velocity is compared to the desired second end tilt velocity to determine whether the complex attachment 350 is achieving the desired tilt velocity. If the measured second end tilt velocity is different, a slight adjustment is made to the desired tilt velocity to generate an adjusted second end tilt velocity. Similarly, a measured point-of-interest rotation velocity is compared to the desired point-of-interest rotation velocity to determine whether the complex attachment 350 is achieving the desired point-of-interest rotation velocity. If the measured point-of-interest rotation velocity is different, a slight adjustment is made to the desired point-of-interest rotation velocity to generate an adjusted point-of-interest rotation velocity. No adjustment may be necessary if the complex attachment is achieving the desired velocities, and the adjusted velocities can be the same as the desired velocities.

The adjusted second end tilt velocity and the adjusted point-of-interest rotation velocity generated by the feedback control subsystem are provided as inputs to the synchronization subsystem 440, which synchronizes the three desired velocities of the work implement (e.g., the desired boom pivot velocity, the desired arm pivot velocity, and the desired bucket pivot velocity (referred to below as the machine desired velocities)) from the velocity determination subsystem 430 with the two adjusted velocities from the feedback control subsystem 450 (referred to below as the working tool desired velocities). The synchronization compensates for any known latencies between the control functions that would cause one of the machine desired velocities or the working tool desired velocities to be achieved before the other of the machine desired velocities or the working tool desired velocities. The latencies are characterized by collecting data on a machine and on a complex attachment 350 and deriving a multi-order transfer function to represent the relationship between the latencies. The synchronization subsystem may not be needed in systems having no latencies or minimal latencies.

The synchronized velocities for the machine controlled functions (e.g., the boom pivot velocity, the arm pivot velocity, and the bucket pivot velocity) generated by the synchronization subsystem 440 are provided to a machine hydraulic system controller subsystem 460, which controls pumps and valves in a conventional manner to produce the respective synchronized velocities for the boom, the arm, and the bucket, wherein the conventional bucket is replaced by the first (upper) portion 360 of the complex attachment 350.

The synchronized working tool desired velocities generated by the synchronization subsystem 440 are provided to the attachment controller 400, which implements control algorithms to selectively apply hydraulic pressure to the at least one hydraulic (tilt) actuator 370 to control the tilting of the second (lower) portion 362 with respect to the first (upper) portion 360 of the complex attachment 350 and to selectively apply hydraulic pressure to the internal hydraulic motor 384 (FIG. 7) to control the rotation of the working tool 352. The hydraulic actuator and the hydraulic motor operate to move the point-of-interest 354 of the working tool along a selected trajectory as described above. In the illustrated embodiment, the synchronized tilt and rotation velocities from the synchronization subsystem 440 of the machine controller 210 to the attachment controller are provided in real units (e.g., degrees per second) such that the attachment controller is able to generate the requested motions relative to the working tool-to-arm linkage joint 154.

The complex attachment 350 does not need information regarding the locations and velocities of the components of the work implement 140. The machine controller 210 does not need to know how the attachment controller 400 of the complex attachment achieves the requested tilt of the second portion and the requested rotation of the working tool support structure 380. Accordingly, when a new complex attachment is attached to the work vehicle 120, the machine controller only needs to receive information about the tilt range of the second (lower) portion 362 and the rotation range of the working tool support structure 380 so that calculated requests are generated within the requested ranges. For example, in certain embodiments of the complex attachment, the rotation range of the working tool support structure can be a full circle (e.g., 360 degrees).

As discussed above, the attachment controller 400 provides feedback to the feedback control subsystem 450 within the machine controller 210 to inform the feedback controller about the actual tilt and rotation velocities. The attachment controller also provides an auxiliary flow request signal to the machine hydraulic system controller 460 that indicates the hydraulic pressure and flow required to achieve the desired rotation and tilt velocities for the complex attachment 350. The hydraulic fluid is provided to the complex attachment via the at least one hydraulic supply line 372. As discussed above, the complex attachment controls the application of the hydraulic pressure and flow to the at least one hydraulic actuator 370 and to the internal hydraulic motor 384 (FIG. 7) within the complex attachment 350.

Figure 8:
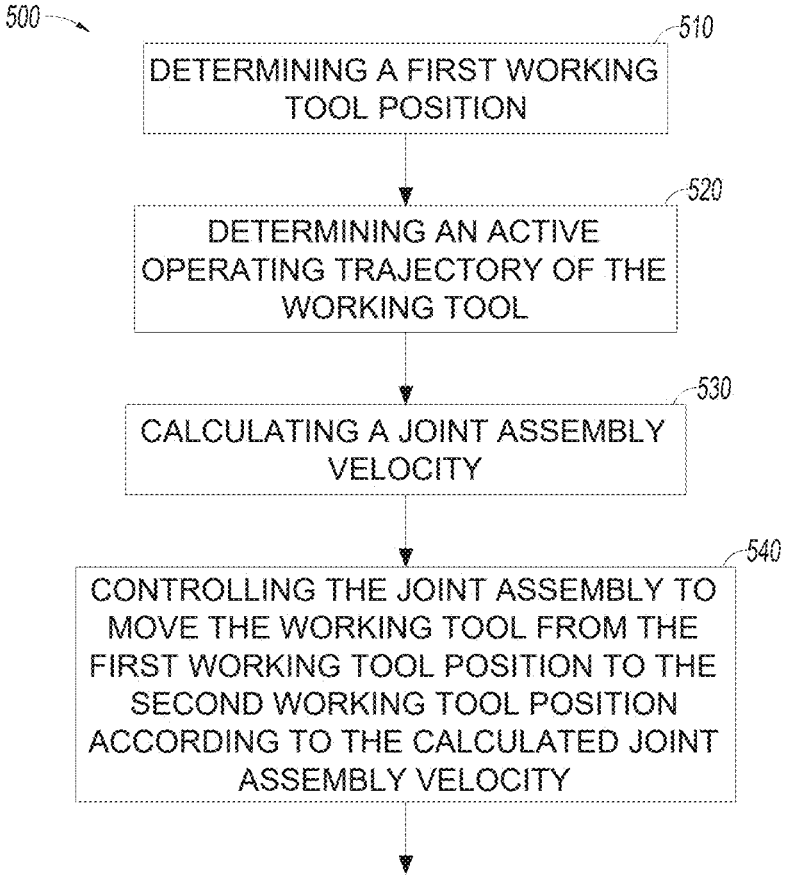
FIG. 8 illustrates a flowchart of the operation of a control function for controlling the point of interest of the working tool.

FIG. 8 is a flowchart of an exemplary embodiment of a method 500 for controlling the point-of-interest 354 of the working tool 352 attached to the second (lower) portion 362 of the complex attachment 350. In particular, the disclosed method discloses an automated process for the work vehicle 120 to control the working tool along a trajectory using the joint assembly, including when the working tool is oriented at a complex angle, necessitating a combination of velocities from the joints in the joint assembly and/or other structures of the work vehicle to automatically move the working tool along the trajectory. The automated control allows the system to operate efficiently and accurately during operation and enables the complex attachment to seamlessly integrate with the sensor system 200 to allow the operator to control the working tool 352 using the same or similar command operations used to control the working tool 146 that does not have an attached complex attachment, even when the working tool 352 is positioned in a complex angle. The automatic control further adds predictability to the machine's operation by performing operations with greater consistency regardless of the orientation of the working tool relative to the machine.

The method 500 can be initiated by a control input, for example from an operator. The control input can alternatively be received remotely. The control input can, for example, be a command to move the working tool 352 between a curl and a dump position or any set of intermediate positions. The control input can, in some embodiments, further include additional information such as a desired speed of the working tool. In some embodiments, the control input may command the working tool to move along the desired trajectory starting at the current position of working tool. This may be considered the initial working tool position for the operation. In other embodiments, the control input may further move the working tool 352 from the current position to a better position to begin the curl or dump operation. For example, before initiating a curl operation to cut or dig into the work surface, the control input may move the working tool from the end point of the dump operation to an intermediate position between the endpoints of the curl and dump operations, thereby allowing the operator to place the working tool next to the ground surface.

The method 500 begins in a first step 510 in which the position of the working tool 352 is determined. In some embodiments, this position may be determined relative to the main frame, the work implement, any other point of reference on the machine, or as part of a global reference coordinate system of the work site. The position of the working tool may be determined using any combination of sensors or position data that would occur to a person of skill in the art. For example, in some embodiments, the position of the working tool can be determined by determining the angular position of the working tool-to-arm linkage joint 154, integral complex attachment linkage joint 364, and working tool support structure 380. These angular positions can determine or represent a curl component, a tilt component, and a swivel component, respectively, of the position of the working tool. In some other embodiments, the sensor system 200 may be able to directly detect the position of the working tool. The determined position can, for example, more specifically determine the position of the point of interest 354, the cutting edge 356, or both.

In a second step 520, an active operating trajectory 550 is determined for moving the working tool 352 between the position from step 510 to a second working tool position. The second working tool position can be, for example, an end point of the curl operation, the end point of the dump operation, or any intermediate position. Similar to the position from step 510, this position can again include a curl component, a tilt component, a swivel component, or any combination thereof.

In an embodiment where the trajectory is the curl/dump operation, the active operating trajectory 550 is a curved path, or arc, that the working tool follows as it moves between the first and second working tool positions. The active operating trajectory 550 in some embodiments can be determined based on the position of the cutting edge 356. The method can determine a vector along the cutting edge 356 and determine a second vector normal (i.e., perpendicular) to the cutting edge 356. The perpendicular vector can, for example, intersect the cutting edge at the point of interest 354 and be perpendicular in the rotation plane 392 or any other plane containing the cutting edge vector. The method can then determine the curved path, or arc, defining the active operating trajectory 550 based on the perpendicular vector. The active operating trajectory 550 involves a combination of rotational movements around the third pivot axis 186 and the tilt axis 366, creating an arcing motion that is generally perpendicular to the point of interest 354. The active operating trajectory 550 may also optionally combine rotational movement around the rotation axis 382. During the curl/dump operation, for example, this orientation of the active operating trajectory 550 to the point of interest 354 enables the working tool optimizes the amount of material that can be loaded into the working tool and can further maintain an angle of the working tool that minimizes spilling of material before dumping the material.

The active operating trajectory 550 may include a curl component, a tilt component, a swivel component, or any combination of the components. Further, other positional components for a machine reference coordinate system, a global reference coordinate system, or any other coordinate system that may occur to a person of skill in the art may further be used. Further, some embodiments may additionally incorporate the position and movement of the work implement 140 or the main frame 130.

In a third step 530, a curl velocity of the working tool is calculated for pivoting about the curl axis and a tilt velocity of the working tool 352 is calculated for pivoting around the tilt axis. When combined, these two velocities move the working tool along the active operating trajectory 550 at a joint assembly velocity. The curl velocity can be the angular velocity about the third pivot axis 186. The curl velocity can be achieved by pivoting about the working tool-to-arm linkage joint 154. The tilt velocity can be the angular velocity about the tilt axis 366. The tilt velocity can be achieved by pivoting about the integral complex attachment linkage joint 364. In some embodiments, the system may further determine the joint assembly velocity by calculating a rotation velocity and combine the rotation velocity with the curl velocity and the tilt velocity. The rotation velocity can be the angular velocity about the rotation axis 382. The rotation velocity can be achieved by pivoting about the working tool support structure 380. The desired movements may be achieved by manipulating the actuators associated with each joint. In other embodiments, the calculated velocities can further be determined using a ratio of the angular velocities determined to move the working tool in the active operating trajectory. Conversely, the calculated velocities can also be used to determine a ratio for the angular velocities to move the working tool in the active operating trajectory 550. These ratios may, for example, enable the system to move the working tool at different speeds while still moving the working tool 352 along the active operating trajectory.

In a fourth step 540, the joint assembly is controlled to move the working tool 352 according to the calculated curl and tilt velocities, thereby moving the working tool along the active operating trajectory 550. This control can occur, for example, in response to the control input. Thus, the exemplary method 500 automatically controls the working tool by synchronizing the movements of various joints at precise velocities, enabling the working tool to move according to an active operating trajectory.

Such automatic control allows the system to operate efficiently and accurately. In the embodiment where the working tool 352 is an excavator bucket, for example, this automatic control optimizes the material handling operations by maximizing the material loaded into the working tool during the curl/cut operation while also minimizing spilling of material. Further, in a dump operation, the automatic control ensures that the material in the working tool is dumped at the intended location with greater precision.

As described herein, the complex attachment 350 can be coupled to the arm 144 of the work implement 140 of a work vehicle 120 in place of a conventional working tool 146, and a working tool 352 can be coupled to the working tool support structure 380 of the complex attachment 350. The machine controller 210 of the work vehicle does not control the actuators of the complex attachment directly. Rather, the work vehicle provides hydraulic pressure and flow to the complex attachment via the at least one hydraulic supply line 372 and provides synchronized target velocities to the complex attachment. The complex attachment manipulates the at least one hydraulic actuator 370 to tilt the second (lower) portion 362 of the complex attachment and manipulates the internal hydraulic motor 384 (FIG. 7) of the complex attachment to rotate the working tool support structure 380 and the attached working tool.

Figure 9:
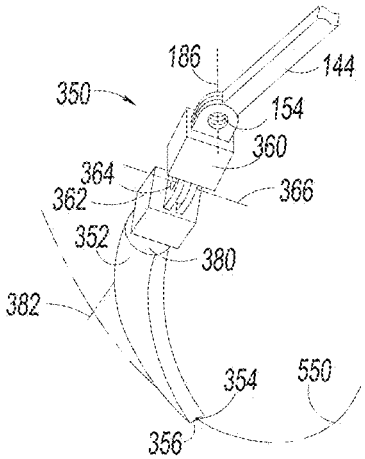
FIG. 9 is a schematic representation of the components of the joint assembly of FIG. 6, which further shows the curling, pivoting, and swiveling (rotation) of the working tool by the joint assembly in a dig position.
Figure 10:
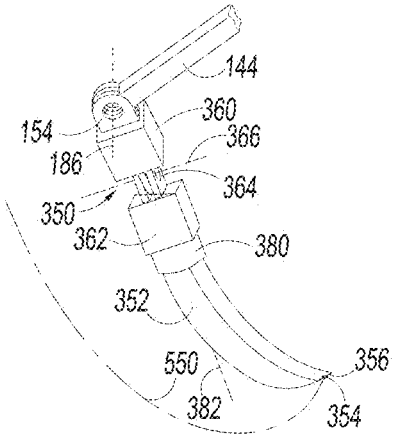
FIG. 10 is a schematic representation of the components of the joint assembly of FIG. 6, which further shows the curling, pivoting, and swiveling (rotation) of the working tool by the joint assembly in a carry position.
Figure 11:
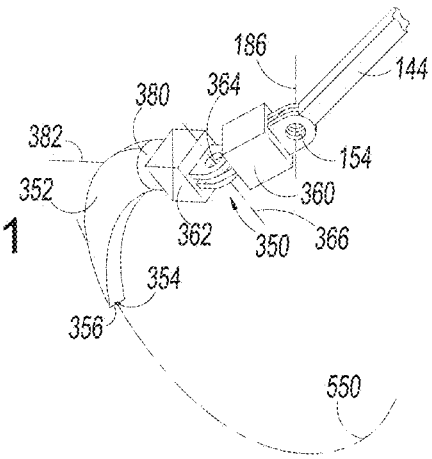
FIG. 11 is a schematic representation of the components of the joint assembly of FIG. 6, which further shows the curling, pivoting, and swiveling (rotation) of the working tool by the joint assembly in a dump position.

FIGS. 9, 10, and 11 illustrate the operation of the joint assembly and work implement 140 to move the working tool 352 between a cutting position (FIG. 9), a curl position (FIG. 10), and a dump position (FIG. 11). As illustrated, the angular position of the arm 144 with respect to the boom 142, the angular pivot of the first (upper) portion 360 of the complex attachment 350 about the working tool-to-arm linkage joint 154, the angular pivot of the second (lower) portion 362 of the complex attachment with respect to the first (upper) portion about the integral complex attachment linkage joint 364, and the swivel angle of the working tool support structure 380 with respect to the second (lower) portion can each be adjusted by the machine controller 210 to maintain the point-of-interest 354 of the working tool on the active operating trajectory 550. Although not illustrated in FIGS. 9-11, the pivot angle of the boom with respect to the main frame 130 can also change.

Thus, although there have been described particular embodiments of the present disclosure of a new and useful system for controlling a working tool, it is not intended that such references be construed as limitations upon the scope of this disclosure except as set forth in the following claims.

What is claimed is:

1. A work machine comprising:

a main frame;

a work implement including a first end movably coupled to the main frame and a second end distal with respect to the main frame;

a joint assembly coupled to the second end of the work implement;

a working tool including a cutting edge, the working tool associated with the joint assembly, the joint assembly configured to actuate the working tool such that the working tool is operable to move between a first working tool position and a second working tool position, wherein, the joint assembly comprises:

a curl joint configured to enable the working tool to pivot about a curl axis;

a tilt joint configured to enable the working tool to pivot about a tilt axis;

a swivel structure configured to enable the working tool to rotate about a swivel axis; and one or more processors configured to:

determine the first position of the cutting edge relative to at least one of the main frame or the work implement;

determine an active operating trajectory to move the working tool between the first working tool position and the second working tool position, the active operating trajectory based on a vector normal to the first position of the cutting edge;

calculate a curl velocity of the working tool pivoting about the curl axis and calculate a tilt velocity of the working tool pivoting around the tilt axis such that the two velocities combine to move the working tool along the active operating trajectory; and control the joint assembly to move the working tool according to the calculated curl and tilt velocities.

2. The machine of claim 1, further comprising:

one or more sensors associated with the working tool and the joint assembly, wherein the one or more sensors are configured to determine at least a curl position, a tilt position, a swivel position, or any combination thereof of the working tool.

3. The machine of claim 2, wherein the one or more processors are further configured to:

determine an instantaneous cutting edge position using the curl position, the tilt position, the swivel position, or any combination thereof.

4. The machine of claim 1, further comprising:

a sensor associated with the working tool and configured to determine one or more of a pitch, roll, or yaw of the working tool.

5. The machine of claim 4, wherein the one or more processors are further configured to:

determine an instantaneous cutting edge position using one or more of the pitch, the roll, or the yaw of the working tool.

6. The machine of claim 1, wherein the one or more processors are further configured to:

receive a control input to move the working tool between the first working tool position and the second working tool position.

7. The machine of claim 6, wherein the one or more processors are further configured to:

control the joint assembly to move the working tool according to the calculated curl and tilt velocities in response to the control input.

8. The machine of claim 1, wherein calculating the velocity of the joint assembly further comprises:

calculating a ratio of the curl and tilt velocities to determine a joint assembly velocity.

9. The machine of claim 1, wherein:

each of the first working tool position and the second working tool position includes a respective curl component, a respective tilt component, and a respective swivel component.

10. The machine of claim 1, wherein:

the joint assembly is configured to connect the work implement to the curl joint and the working tool to the swivel structure.

11. A computer-implemented method of controlling a working tool of a work machine, the method comprising:

determining a first cutting edge position of a cutting edge of the working tool relative to at least one of a main frame or a work implement coupled to the main frame, the working tool further coupled to the work implement by a joint assembly;

determining an active operating trajectory of the working tool based on a vector normal to the first position of the cutting edge, wherein the active operating trajectory of the working tool moves the working tool along a desired path between a first working tool position and a second working tool position;

calculating a joint assembly velocity, the joint assembly velocity including a curl component and a tilt component, the joint assembly velocity configured to move the working tool based on the active operating trajectory; and controlling the joint assembly to move the working tool from the first working tool position to the second working tool position according to the calculated joint assembly velocity.

12. The method of claim 11, wherein determining the working tool position further comprises:

determining the working tool position using a curl position, a tilt position, a swivel position, or any combination thereof of the working tool determined by one or more sensors associated with the working tool and the joint assembly.

13. The method of claim 11, wherein determining the working tool position further comprises:

determining the working tool position using one or more of a pitch, a roll, or a yaw of the working tool determined by one or more sensors associated with the working tool.

14. The method of claim 11, further comprising:

receiving a control input to move the working tool between the first working tool position and the second working tool position.

15. The method of claim 14, further comprising:

controlling the joint assembly to move the working tool according to the calculated joint assembly velocity in response to the control input.

16. The method of claim 14, wherein:

the control input includes a speed at which to move the working tool.

17. The method of claim 11, further comprising:

moving the working tool from an initial working tool position to the first working tool position before moving the working tool from the first working tool position to the second working tool position along the active operating trajectory.

18. The method of claim 11, wherein calculating the joint assembly velocity further comprises:

calculating a ratio of the curl component and the tilt components of the joint assembly velocity.

19. The method of claim 11, wherein:

each of the first working tool position and the second working tool position includes a curl component, a tilt component, and a swivel component.

20. The method of claim 11, wherein:

the joint assembly comprises a curl joint to enable the working tool to pivot about a curl axis, a tilt joint to enable the working tool to pivot about a tilt axis, and a swivel structure to enable the working tool to rotate about a swivel axis.

* * * * *